US009233515B2

(12) United States Patent
Cook et al.

(10) Patent No.: US 9,233,515 B2
(45) Date of Patent: Jan. 12, 2016

(54) CLAMSHELL CARTON WITH TEAR STRIP

(71) Applicant: LBP Manufacturing, Inc., Cicero, IL (US)

(72) Inventors: Matthew R. Cook, Oak Brook, IL (US); Thomas Fu, Naperville, IL (US); James Hubbard, Oak Lawn, IL (US); Earle Ellis, Westchester, IL (US); Lauren Mikos, Chicago, IL (US); Kevin Fultz, Crestwood, IL (US); Jonathan Smyk, Chicago, IL (US)

(73) Assignee: LBP Manufacturing LLC, Cicero, IL (US)

( * ) Notice: Subject to any disclaimer, the term of this patent is extended or adjusted under 35 U.S.C. 154(b) by 21 days.

(21) Appl. No.: 13/892,018

(22) Filed: May 10, 2013

(65) Prior Publication Data

US 2014/0332584 A1 Nov. 13, 2014

(51) Int. Cl.

| | |
|---|---|
| ***B65D 5/54*** | (2006.01) |
| ***B31B 1/16*** | (2006.01) |
| ***B31B 1/25*** | (2006.01) |
| ***B31B 1/26*** | (2006.01) |

(Continued)

(52) U.S. Cl.

CPC ..... *B31B 1/26* (2013.01); *A47G 21/001* (2013.01); *B31B 1/16* (2013.01); *B31B 1/25* (2013.01); *B65D 5/5475* (2013.01); *B65D 5/667* (2013.01); *B31B 2203/062* (2013.01); *B31B 2203/084* (2013.01); *B31B 2203/101* (2013.01); *B31B 2219/924* (2013.01)

(58) Field of Classification Search

CPC ..... B65D 5/5475; B65D 5/667; A47G 21/001

USPC ..... 229/114, 146, 235, 240, 242, 902, 906

See application file for complete search history.

(56) References Cited

U.S. PATENT DOCUMENTS 2,811,455 A 10/1957 Erekson
3,276,665 A * 10/1966 Rasmussen ..... 229/235

(Continued)

FOREIGN PATENT DOCUMENTS

DE 2236414 A1 * 2/1974 ..... B65D 5/5475
WO 2008124193 A1 10/2008

OTHER PUBLICATIONS

International Search Report dated Sep. 24, 2014, for corresponding International Application No. PCT/US2014/037155 filed May 7, 2014 (3 pages).

*Primary Examiner* — Gary Elkins

(74) *Attorney, Agent, or Firm* — Fitch, Even, Tabin & Flannery LLP

(57) ABSTRACT

A carton includes a top portion and a bottom portion. Each portion includes a front wall, a rear wall, and opposing side walls extending therebetween. The top portion and bottom portion include respective top and bottom surfaces. The rear walls of the top and bottom portions are hingedly connected to another along respective outer edges. When closed, the top portion and bottom portion define a cavity for storing an item. The carton also includes a separation region defined on the top and bottom portions that extends from an outside edge of the front wall of the top portion, around the top portion and the bottom portion, to an outside edge of the front wall of the bottom portion. The separation region is configured to facilitate controlled separation of the carton into first and second side portions and to prevent liquid flow through separation region.

10 Claims, 5 Drawing Sheets

(51) Int. Cl.
*B65D 5/66* (2006.01)
*A47G 21/00* (2006.01)

(56) References Cited

U.S. PATENT DOCUMENTS 3,465,946 A * 9/1969 Johnson ..... 229/235
3,502,257 A * 3/1970 Virros ..... 229/235
4,008,849 A * 2/1977 Baber ..... 229/235
4,039,120 A * 8/1977 Herzog ..... 229/235
4,817,803 A 4/1989 Risucci
4,826,016 A * 5/1989 Foster ..... 229/120.011
5,375,761 A 12/1994 Sullivan
5,522,537 A * 6/1996 Barlow ..... 229/109
6,073,833 A 6/2000 Desrosiers et al.
6,935,557 B2 * 8/2005 Aubry et al. ..... 229/235
8,215,539 B2 7/2012 Stonehouse
8,393,529 B2 * 3/2013 Volz et al. ..... 229/235
8,622,280 B2 * 1/2014 Coltri-Johnson et al. .... 229/235
8,820,621 B2 * 9/2014 Burke et al. ..... 229/146
2004/0101605 A1 * 5/2004 Sigel ..... 426/394
2004/0217154 A1 11/2004 George
2007/0131749 A1 * 6/2007 Coltri-Johnson et al. .... 229/242
2007/0221717 A1 * 9/2007 Burke et al. ..... 229/146
2007/0295793 A1 12/2007 Ho Fung et al.
2008/0006679 A1 * 1/2008 Volz et al. ..... 229/117.01
2011/0084121 A1 4/2011 Sanders
2013/0112742 A1 * 5/2013 D'Amato ..... 229/235

* cited by examiner

CLAMSHELL CARTON WITH TEAR STRIP

BACKGROUND

Clamshell cartons are utilized in food service industries to hold various food items, such as hamburgers and hot dogs. Typical cartons are made from cardboard. Printing may be provided on one side of the carton to identify the food item within the carton.

During normal usage, a server may place a sandwich, hamburger or other food item into the carton and then close the carton. A consumer typically removes the food item by reaching around the side of the food item and into the carton to grasp the bottom of the food item.

BRIEF SUMMARY

In one aspect, a carton includes a top portion and a bottom portion. Each portion includes a front wall, a rear wall, and opposing sidewalls extending therebetween. The top portion and bottom portion include respective top and bottom surfaces. The rear walls of the top and bottom portions are hingedly connected to another along respective outer edges. When closed, the top portion and bottom portion define a cavity for storing an item. The carton also includes a separation region defined on the top and bottom portions that extends from an outside edge of the front wall of the top portion, around the top portion and the bottom portion, to an outside edge of the front wall of the bottom portion. The separation region is configured to facilitate controlled separation of the carton into first and second side portions and to prevent liquid flow through separation region.

In a second aspect, a method for manufacturing a carton includes providing a planar material. The material is cut to remove excess material. A separation region is formed along a major axis of the cut planar material. The separation region is configured to facilitate controlled separation of the carton, when assembled, into first and second side portions and to prevent liquid flow through separation region.

Other features and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The components in the figures are not necessarily to scale, emphasis instead being placed upon illustrating the principles of the design. Moreover, in the figures, like-referenced numerals designate corresponding parts throughout the different views.

DETAILED DESCRIPTION

The exemplary embodiments below describe a food carton that includes an integrated tear strip feature. The tear strip facilitates vertically parting the food carton into two halves. The tear strip may include a group of perforations. A barrier material may be applied over the perforations to prevent liquid from flowing through the perforations. After parting, a consumer may grasp a food item stored therein in a manner that minimizes the likelihood of his hands becoming messy.

Figure 1A:
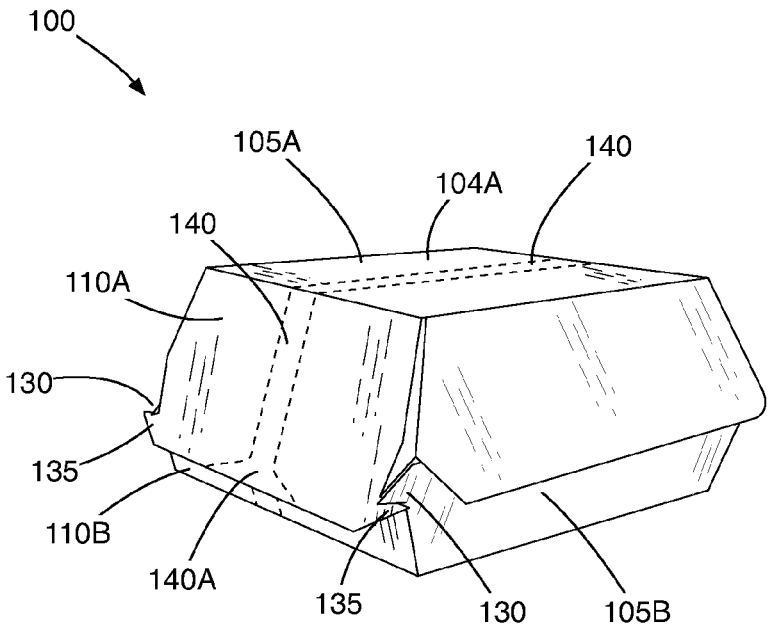
FIGS. 1A and 1B are perspective views of an exemplary carton that includes a tear strip in both closed and open configurations.
Figure 1B:
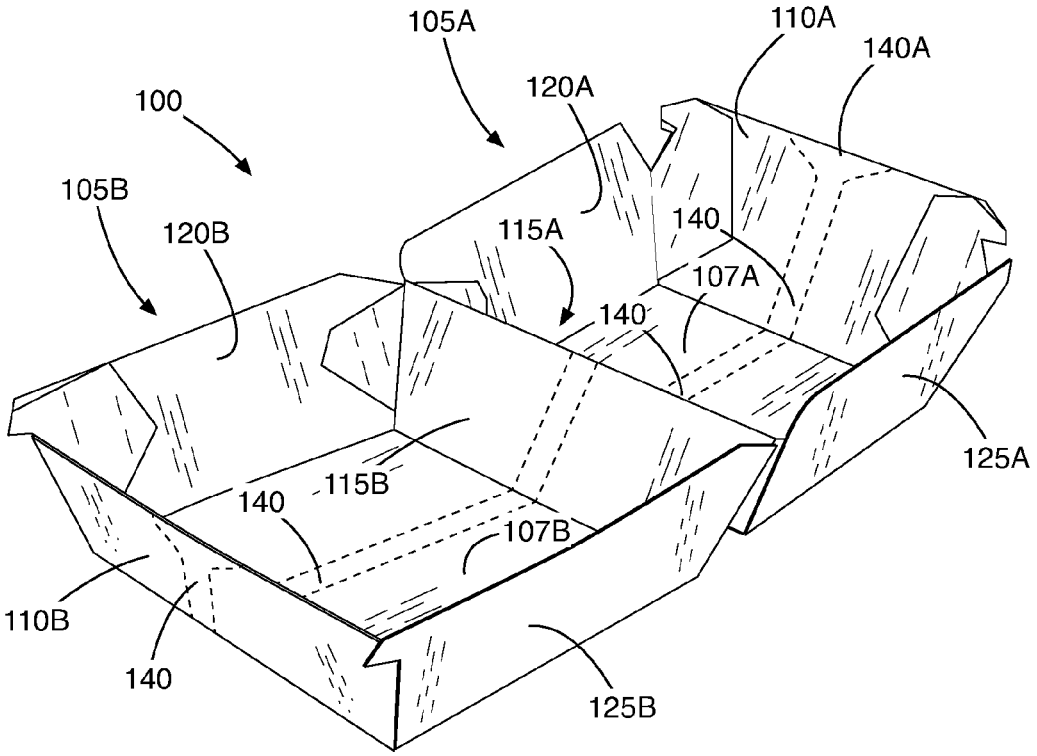

FIGS. 1A and 1B illustrate perspective views of a clamshell carton 100 in both closed and open configurations. The carton 100 includes a top portion 105A and a bottom portion 105B. Each portion (105AB) includes a front wall 110AB, a rear wall 115AB, and opposing sidewalls (120AB and 125AB). A top surface 107A and bottom surface 107B extend respectively between the walls of the top portion 105A and the bottom portion 105B.

The top portion 105A and bottom portion 105B are hingedly attached to one another along a shared top edge of the rear walls (115AB). The front wall 110A of the top portion 105A and the front wall 110B of the bottom portion define, respectively, a pair of outwardly extending fingers (130 and 135) that extend from respective edges of the front walls 110AB. The fingers (130 and 135) are configured to engage one another to secure the top portion 105A and bottom portion 105B of the carton together and thereby maintain the carton 100 in the closed configuration of FIG. 1A.

The tear strip 140 is defined along both the top portion and bottom portion 105AB. The tear strip 140 extends between outside edges of the front walls 110AB. That is, the tear strip 140 is defined along the front wall 110A, top surface 107A, and rear wall 115A, of the top portion 105A, and the front wall 110B, bottom surface 107B, and rear wall 115B of the bottom portion 105B. A pull-tab 140A is provided on the section of the tear strip 140 that is defined on the front wall 110A of the top portion 105A.

Figure 2A:
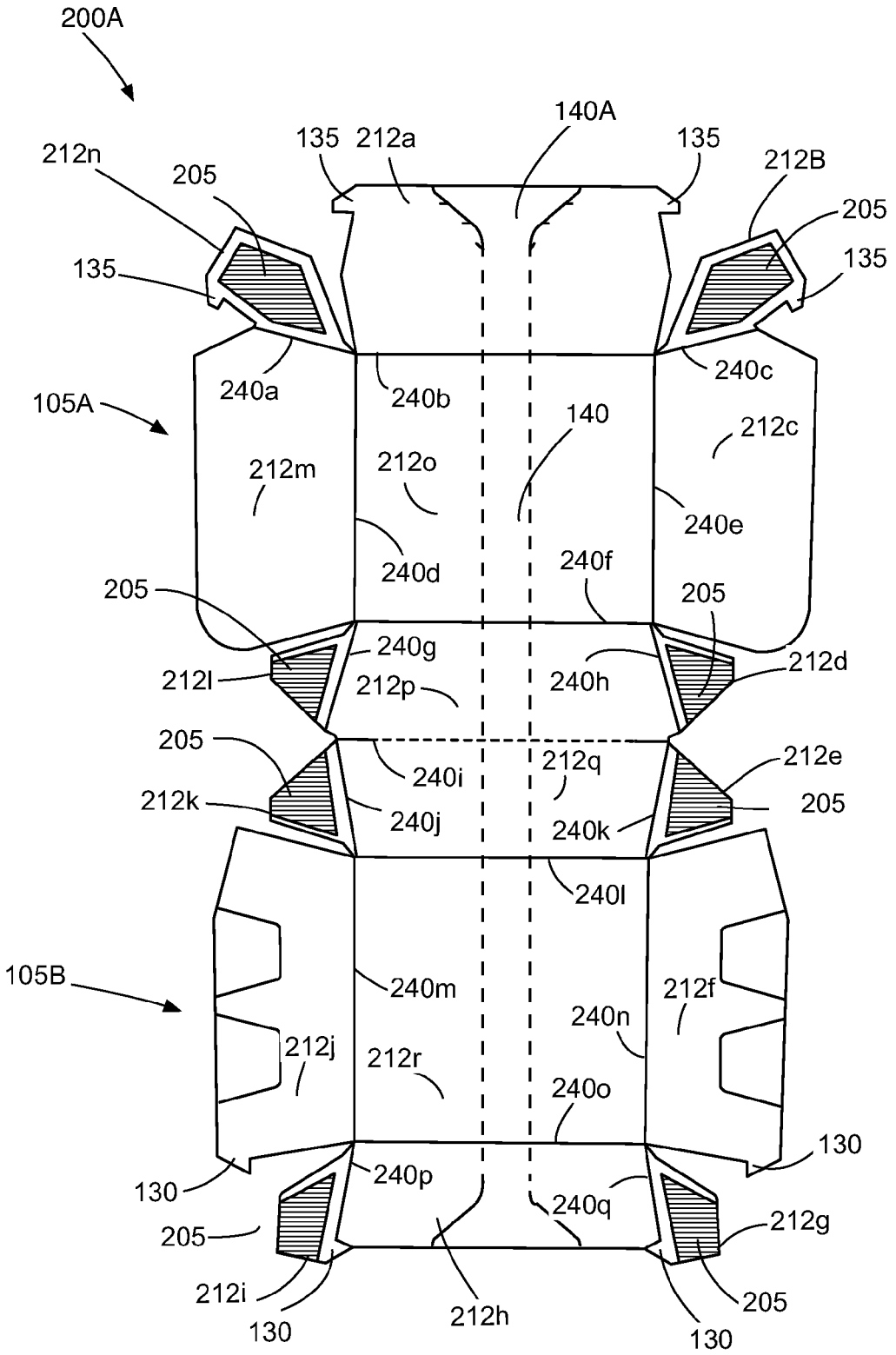
FIGS. 2A and 2B illustrate exemplary plan views of first and second planar sheet embodiments that may be formed into the carton of FIGS. 1A and 1B.
Figure 2B:
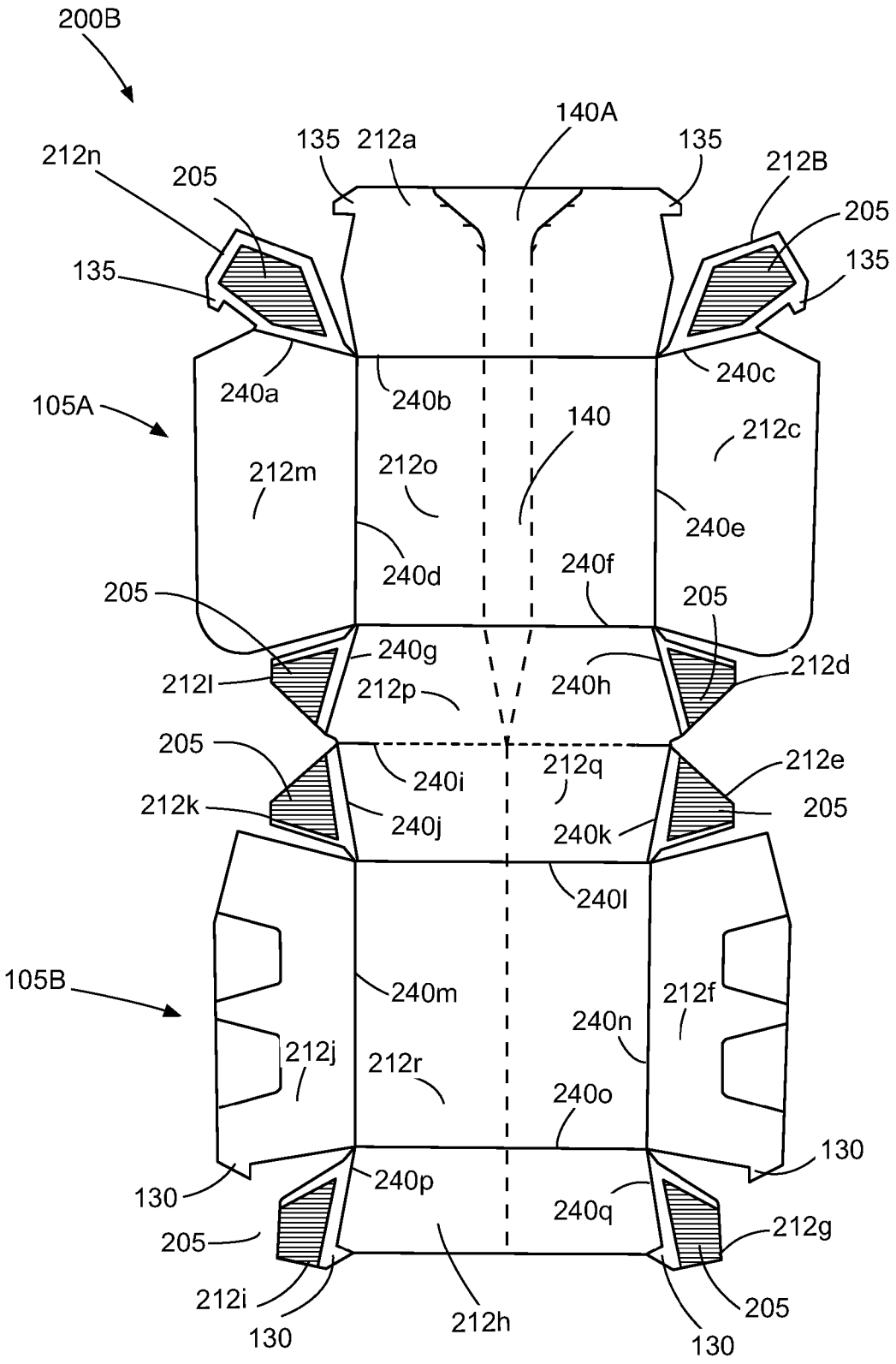

FIGS. 2A and 2B illustrate exemplary plan views of first and second planar sheet embodiments 200AB that may be formed into the carton 100 of FIG. 1. The sheets 200AB may be cut out from a larger sheet of material, such as a corrugated paper material, cardboard, paperboard, plastic or any other material that may be creased, folded and bonded, as described above, that is suitably rigid for storing food items.

Referring to FIG. 2A, the sheet 200A includes a series of creases 270*a-q* that define a plurality of planar regions 212*a-r* that define the carton 100. Also shown are a series of regions 205 to which an adhesive may be applied. The adhesive is utilized to bond the plurality of planar regions 212*a-r* to one another. During production, the planar regions 212*a-r* are folded about the creases 270*a-q* resulting in the assembled carton configuration shown in FIG. 1A. For example, referring to FIG. 1A, the front surface 110A of the carton 100 in the assembled configuration includes the three planar regions 212*abn*, shown on the top of FIG. 2. In this case, the right and left upper planar regions 212*b* and 212*n* are disposed behind the center planar region 212*a* when the carton 100 is assembled.

Each of the three regions 212*abn* includes locking finger regions 135 which, when assembled, correspond to the locking fingers 135, shown in FIG. 1. Similarly, the bottom three regions 212*ghl* include locking finger regions 130 which, when assembled, correspond to the locking fingers 130 extending from the bottom portion 115 of the carton 100.

As illustrated, the tear strip 140 is generally defined along the major axis of the sheet 200A. The outline that defines the tear strip 140 may correspond to a pattern of repeated 9/16 inch segments that are separated by a 1/16 inch perforation. The length of the segments and the perforation between them may be different. For example, the segments may be 3/8 inch, 1/16 inch or a different length. The distance between the segments may be 1/32 inch or a different distance. Factors to be considered when determining the length of the segments and the distance between them include the desired ease with which the tear strip can be removed, the loss of structural integrity that results from the perforations, and possible seepage of juices through the perforations. The various dimensions above have been determined to optimally balance these considerations.

To further limit or prevent seepage through the perforations, a barrier coating may be applied over the perforations to prevent seepage of liquids (e.g., water, oil, grease or sauces) contained in the food items. For example, a barrier coating may be applied over the perforations. Such a barrier coating effectively seals the perforations without adversely affecting the ease with which the tear strip 140 may be removed.

In alternative implementations, creases or partial scoring of the working material may be utilized rather than or in combination with the perforations to control the separation of the tear strip. For example, creasing and partial scoring of the working material may be provided in those regions where juices are more likely to seep, such as one or more of the front wall 110B, bottom surface 107B, and rear wall 115B of the bottom portion 105B.

The width of the tear strip 140 may be generally uniform across the length of the sheet 200. For example, the width may be about ¼ inch. As illustrated in FIG. 2B, in alternative embodiments, the width of the tear strip may be about ¼ inch, along a section of the sheet 200B that corresponds to the top portion 105A of the carton 100, and then taper into a single perforated or creased section along a second section of the sheet 200B that corresponds to the second portion 105B.

Figure 3A:
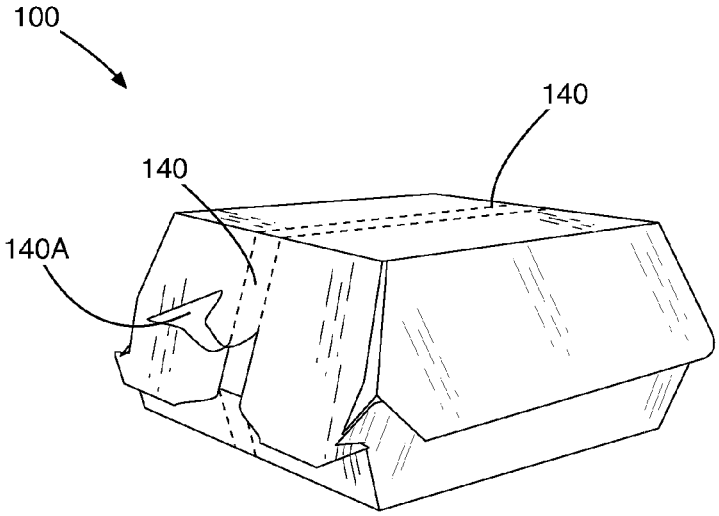
FIGS. 3A and 3B illustrate removal of the tear strip and separation of the carton into left and right portions.
Figure 3B:
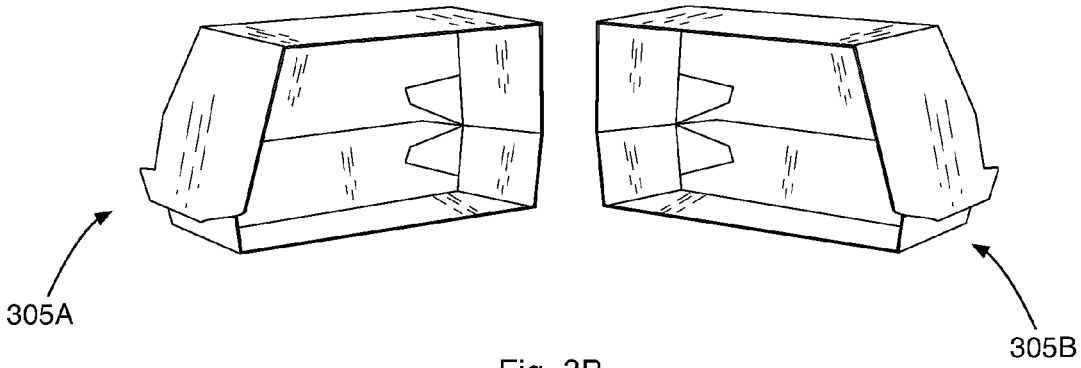

As illustrated in FIGS. 3A and 3B, the tear strip 140 facilitates controlled separation of the carton 100 along a vertical parting line through the carton 100 into left and right portions 305AB. Separation is accomplished by pulling on the pull-tab 140A section of the tear strip 140 until the tear strip is completely severed from the left and right portions 305AB.

During normal usage, a server may place a sandwich, hamburger or other food item into the carton 100 and then close the carton 100, as illustrated in FIG. 1A. As illustrated in FIG. 3A, a consumer may open the carton by pulling on the front wall 110A of the top portion. Alternatively, the consumer may rotate that carton so that the tear strip 140 is generally horizontal and then remove the tear strip 140 by pulling on the pull-tab 140A until the carton 100 separates into the left and right portions 305AB illustrated in FIG. 3B. Because the carton was initially rotated, the open side of the left portion 305A will be facing upward, and about half of the food item (e.g., hamburger) will protrude above the open side. The consumer may then place the left portion 305A of the carton 100 on a counter and proceed to remove the food item. In the case of a hamburger, sandwich, etc., the consumer may remove the food item while grasping only the outside portions of the food item (e.g., buns, slices of bread). That is, the consumer can remove the food item without getting the condiments on his hands, which can tend to happen with conventional clamshell cartons which require the consumer to reach around the side of the food item and into the carton to grasp the bottom of the food item. Alternatively, the consumer may simply grasp the left portion 305A of the carton and eat the portion of the food item that protrudes from the open side thereof. This is particularly advantageous for food items that drip juices or condiments. Thus, the carton 100 provides a more cleanly eating experience. This in turn saves the food service cost in terms of cleanup. For example, fewer napkins are necessary. This also results in less trash and is, therefore, friendlier for the environment.

Figure 4:
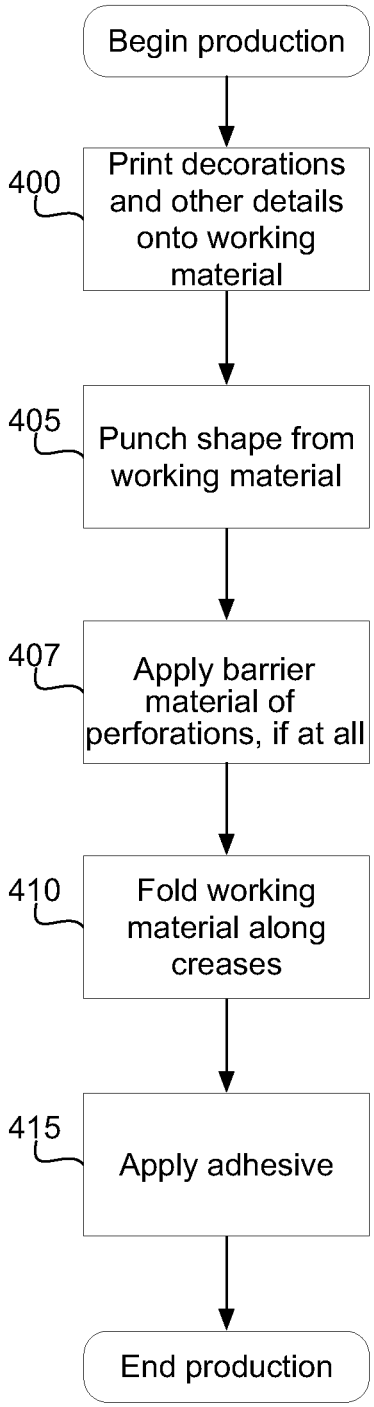
FIG. 4 is a flow diagram illustrating exemplary operations involved in the production of the carton.

FIG. 4 is a flow diagram of exemplary operations carried out during the production of the carton 100 of FIG. 1. At block 400, decorations and other details may be printed on the form. For example, a description of a food item carried in the carton and nutritional information may be printed on the form. In addition, prize information may be printed on the prize information tab.

At block 405, an unassembled carton form is punched from a larger piece of working material. For example, the carton form may correspond to the carton form 200 shown in FIG. 2. The punch may simultaneously cut out material that is not needed, crease the working material to define regions of the carton, and perforate or crease the working material to define the tear strip, as described above.

At block 407, a barrier material may be applied to at least the perforated areas of the tear strip to prevent liquid from flowing through the perforations.

At block 410, the various regions defined in the form may be folded along the creases to provide the carton 100 shown in FIG. 1B.

At block 415, an adhesive may be applied to various regions of the form. The adhesive may be utilized to bond the various regions to one another.

While the carton and method for assembling the carton have been described with reference to certain embodiments, it will be understood by those skilled in the art that various changes may be made and equivalents may be substituted without departing from the scope. For example, the carton described above may be utilized for items other than food. In addition, the operations in manufacturing the carton may be done in a different order. For example, decorations and other details may be printed on the carton form after the carton form is punched from the working material, or the glue dots may be applied earlier than the other operations.

In addition, many modifications may be made to adapt a particular situation or material to the teachings without departing from its scope. Therefore, it is intended that the present method and system not be limited to the particular embodiment disclosed, but that the method and system include all embodiments falling within the scope of the appended claims.

We claim:

1. A carton comprising:

a top portion that includes a front wall, a rear wall, and opposing side walls extending therebetween, and a top surface extending between inside edges thereof;

a bottom portion that includes a front wall, rear wall, and opposing side walls extending therebetween, and a bottom surface extending between inside edges thereof, wherein the rear wall of the top portion and the rear wall of the bottom portion are hingedly connected to another along respective outer edges of the rear walls, wherein when closed, the top portion and bottom portion define a cavity for storing an item;

a separation region comprising a tear strip that extends from an outside edge of the front wall, along the front wall, top surface, and rear wall of the top portion, to the rear wall, bottom surface, and to an outside edge of the front wall of the bottom portion, the tear strip defined by a pattern of repeated uncut segments that are separated by a perforation, wherein a width of the tear strip is uniform across the front wall and top surface of the top portion, then tapers to a narrower width at the top edge of the rear wall, to facilitate controlled separation of the carton into first and second side portions; and a barrier material that covers at least the perforations to prevent liquid from flowing through the perforations, to prevent liquid flow through the perforations of the separation region.

2. The carton according to claim 1, wherein each of the first and second side portions include an entire sidewall of the top portion; a section of the front wall, top surface, and rear wall of the top portion; an entire sidewall of the bottom portion; and a section of the bottom surface, top surface, and rear wall of the bottom portion.

3. The carton according to claim 1, wherein a length of the uncut segment is about 9/16 inch and a length of the perforation is about 1/16 inch.

4. The carton according to claim 1, wherein the carton comprises a corrugated paper material.

5. The carton according to claim 1, wherein the carton is formed from a single sheet of material.

6. The carton according to claim 1, wherein the carton comprises a corrugated paper material.

7. A method for manufacturing a carton, the method comprising:

providing a planar material;

cutting the material to remove excess material;

forming a separation region corresponding to a tear strip along a major axis of the cut planar material, by forming a pattern of repeated uncut segments that are separated from one another by a perforation, where the width of the tear strip is uniform across one or more surface sections that correspond to a front wall and a top surface of the assembled carton, and wherein the tear strip narrows across a surface section that corresponds to a rear wall of the assembled carton; and applying a barrier material over the perforations to prevent liquid from flowing through the perforations, wherein the separation region is configured to facilitate controlled separation of the carton, when assembled, into first and second side portions, and to prevent liquid flow through the perforations of the separation region.

8. The method according to claim 7, further comprising: creasing the planar material to define a plurality of fold lines that define different planar sections of the carton; folding the planar material along the fold lines to thereby provide an assembled carton, wherein the carton includes: a top portion that includes a front wall, a rear wall, and opposing side walls extending therebetween, and a top surface extending between inside edges thereof; and a bottom portion that includes a front wall, rear wall, and opposing side walls extending therebetween, and a bottom surface extending between inside edges thereof, wherein the rear wall of the top portion and the rear wall of the bottom portion are hingedly connected to another along respective outer edges of the rear walls, wherein when closed, the top portion and bottom portion define a cavity for storing an item, wherein the separation region is further defined on the bottom portion and further extends from the top portion, through the bottom portion and to an outside edge of the front wall of the bottom portion.

9. The method according to claim 8, wherein each of the first and second side portions include an entire sidewall of the top portion; a section of the front wall, top surface, and rear wall of the top portion; an entire sidewall of the bottom portion; and a section of the bottom surface, top surface, and rear wall of the bottom portion.

10. The method according to claim 7, wherein a length of the uncut segment is about 9/16 inch and a length of the perforation is about 1/16 inch.

* * * * *